US008328110B2

(12) United States Patent
Sharp

(10) Patent No.: US 8,328,110 B2
(45) Date of Patent: Dec. 11, 2012

(54) ELECTRICAL LOAD DISCONNECT DEVICE WITH ELECTRONIC CONTROL

(75) Inventor: Jeffrey O. Sharp, Lexington, KY (US)

(73) Assignee: Schneider Electric USA, Inc., Palatine, IL (US)

( * ) Notice: Subject to any disclaimer, the term of this patent is extended or adjusted under 35 U.S.C. 154(b) by 753 days.

(21) Appl. No.: 12/499,347

(22) Filed: Jul. 8, 2009

(65) Prior Publication Data

US 2011/0006123 A1 Jan. 13, 2011

(51) Int. Cl.
*G05D 23/19* (2006.01)
*G05D 17/00* (2006.01)

(52) U.S. Cl. ..... 236/46 C; 700/295; 700/296

(58) Field of Classification Search ..... 236/49.3, 236/46 C; 700/276, 291, 295, 296, 300
See application file for complete search history.

(56) References Cited

U.S. PATENT DOCUMENTS 5,316,073 A 5/1994 Klaus et al.
6,167,389 A * 12/2000 Davis et al. ..... 705/412
6,978,627 B2 12/2005 Masui et al.
2005/0216131 A1* 9/2005 Sodemann et al. ..... 700/295
2007/0220907 A1* 9/2007 Ehlers ..... 62/126

* cited by examiner

*Primary Examiner* — Chen Wen Jiang
(74) *Attorney, Agent, or Firm* — Nixon Peabody LLP

(57) ABSTRACT

Electrical load spreading arrangements reduce peak power demand. An enclosure houses an electronic circuit board, which receives at a first input terminal a first thermostat control signal from a thermostat intended to control a first air conditioning unit and at a second input terminal a second thermostat control signal from a thermostat intended to control a second AC unit. A controller on the circuit board is programmed with instructions stored in a memory coupled to the controller causing the controller to monitor the first and second input terminals to determine the timing and duration of the thermostat control signals passed to the output terminals for activating or deactivating the AC units such that overlapping operation of the AC units is reduced particularly during peak demand periods. A similar arrangement may be applied to a broader class of HVAC equipment, including water heaters, for example.

20 Claims, 4 Drawing Sheets

ELECTRICAL LOAD DISCONNECT DEVICE WITH ELECTRONIC CONTROL

FIELD OF THE INVENTION

The present invention relates to the control of electrical loads, particularly for purposes of reducing peak demand for electricity.

BACKGROUND OF THE INVENTION

In many regions, especially during summer months, in which demand for electricity for purposes of air conditioning is increased, "brownout" or rolling blackout conditions routinely occur in which power demand exceeds power availability. These conditions are disruptive to both consumers of electrical power and producers of electrical power. Arrangements whereby such brownout or rolling blackout conditions may be reduced or avoided are much desired.

BRIEF SUMMARY OF THE INVENTION

The present invention, generally speaking, provides electrical load spreading arrangements that allow for power demand during peak usage periods to be reduced. In an embodiment, an electronic circuit board is provided within the enclosure. The electronic circuit board receives at first input terminal a first control wire from a thermostat controlling, for example, a first air conditioning (AC) unit, and receives at a second input terminal a second control wire from a thermostat controlling, for example, a second air conditioning unit. A controller on the circuit board is programmed with instructions stored in a memory coupled to the controller, causing the controller to monitor the first and second input terminals to determine which of the air conditioning units to activate or deactivate via respective first and second output terminals. Load spreading is achieved by producing control signals at the output terminals such that overlapping (e.g., simultaneous) operation of the air conditioning units is reduced. A similar arrangement can be applied to a broader class of heating, ventilation, and air conditioning (HVAC) equipment, including water heaters, for example.

The electronic circuit board essentially takes over the thermostat controls, overriding the thermostat's settings and imposing its own schedule for turning the AC units on and off. It has a simple design, is small, and requires no labor-intensive rewiring of an existing installation except to interpose the electronic circuit board between the thermostat(s) and the AC units.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

DETAILED DESCRIPTION OF THE ILLUSTRATED EMBODIMENTS

Although the invention will be described in connection with certain aspects and/or embodiments, it will be understood that the invention is not limited to those particular aspects and/or embodiments. On the contrary, the invention is intended to cover all alternatives, modifications, and equivalent arrangements as may be included within the spirit and scope of the invention as defined by the appended claims.

Figure 1:
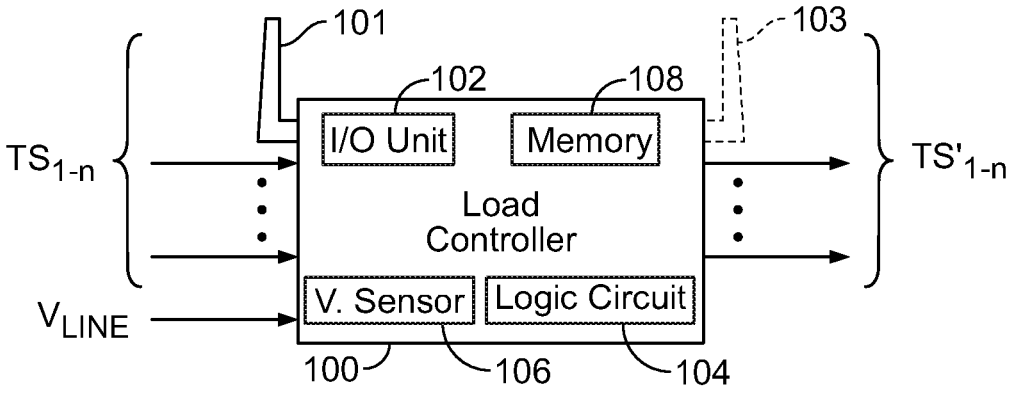
FIG. 1 is a functional block diagram of a load controller for reducing peak power demand.

Referring now to FIG. 1, a functional block diagram is shown of a load controller 100 for reducing peak power demand. The load controller 100 receives control signals such as thermostat control signals $TS_{1-n}$ from corresponding thermostats for various electrical loads such as air conditioners, water heaters, etc. In this example, the load controller 100 is interposed between one or more thermostats and one or more corresponding electrical loads controlled by the thermostats. In a residential setting, air conditioners and water heaters are examples of heavy electrical loads. In other settings, heavy electrical loads can include other types of electrical equipment and machinery. Typically, the loads are not required to operate continuously. In addition, the aggregate ON time of the loads is typically important especially at peak demand times but whether a particular load is ON or OFF at a particular time is less important.

In response to receiving the thermostat control signals $TS_{1-n}$ from n thermostats for the various electrical loads, the load controller 100 produces output control signals $TS'_{1-n}$ that are applied to the various electrical loads to control the electrical loads. In a broad sense, the load controller 100 intercepts the signals from the thermostat that control the operation of the various electrical loads and produces the output control signals $TS'_{1-n}$ that control when the various electrical loads turn on or off. In particular, the thermostat control signals $TS_{1-n}$ are used to achieve "load spreading," in which electrical power to the loads is supplied to reduce overlapping operation of multiple loads simultaneously, particularly during peak demand times, according to a load spreading algorithm stored in a memory 108 coupled to the load controller 100. The thermostat control signals $TS_{1-n}$ and the corresponding output control signals $TS'_{1-n}$ can be handled by an input/output unit 102 of the load controller 100. The load controller 100 can also include a logic circuit 104 coupled to the input/output unit 102 for receiving the thermostat control signals $TS_{1-n}$ via the input/output unit 102, performing load spreading, which produces the output control signals $TS'_{1-n}$ such that overlapping operation of the loads is reduced, and outputting the output control signals $TS'_{1-n}$ to the loads via the input/output unit 102.

The thermostat control signals $TS_{1-n}$ can be received from the corresponding thermostats over wires or wirelessly via the antenna 101 or 103 or both. Similarly, the output control signals $TS'_{1-n}$ can be communicated over wires or wirelessly via the antenna 101 or 103 or both. The load controller 100 can be provided with a single antenna or multiple antennas. In the example of FIG. 1, the antenna 103 is shown in dashed lines for explanatory purposes, but the functions of the antenna 103 can actually be performed by the antenna 101. The thermostat control signals $TS_{1-n}$ and the output control signals $TS'_{1-n}$ can also be received and sent using known power-line carrier (PLC) arrangements in which data signaling is performed over power distribution lines. In a preferred implementation, the load controller 100 is interposed between wiring that connects an existing one or more thermostats to one or more corresponding loads. The wiring from the installed thermostats is disconnected from the corresponding loads and reconnected to the inputs of the load controller 100 for receiving the thermostat control signals $TS_{1-n}$, and the outputs of the load controller that output the output control signals $TS'_{1-n}$ are connected to the loads.

Figure 2:
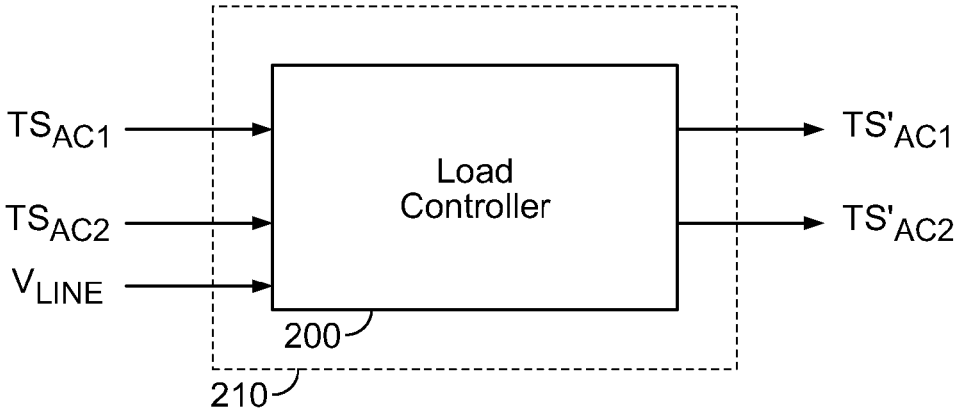
FIG. 2 is a functional block diagram of a specific load controller like that of FIG. 1.

The load controller 100 can also receive a line voltage input, $V_{LINE}$, for monitoring a supply line voltage used to supply power to the electrical loads. The load controller 100 monitors the line voltage input $V_{LINE}$ via a conventional voltage sensor 106 to detect a power loss such as a dropout, a brownout, or a blackout condition, on the supply line. Referring to FIG. 2, a functional block diagram is shown of a specific load controller 200 like that of FIG. 1. In this example, the thermostat control signals, $TS_{AC1}$ and $TS_{AC2}$, respectively, are for controlling two conventional residential air conditioning units (not shown). In the case of a two-story residence, a common arrangement is to have two separate air conditioning units, one for cooling the first floor level and one for cooling the second floor level. These two air conditioning units are commonly located side-by-side outside the residence. In response to the thermostat control signals, $TS_{AC1}$ and $TS_{AC2}$, the load controller 200 produces two output control signals, $TS'_{AC1}$ and $TS'_{AC2}$. In the illustrated embodiment, the load controller 200 is provided within a single enclosure or housing 210. Any of the other load controllers discussed herein can also be enclosed within an enclosure or housing. Like the load controller 100, the load controller 200 is preferably interposed between wiring that connects an existing set of thermostats to a corresponding set of AC units by disconnecting the wiring from the thermostats to the corresponding AC units and reconnecting the wiring to the inputs of the load controller 200 for receiving the thermostat control signals, $TS_{AC1}$ and $TS_{AC2}$, and connecting the outputs of the load controller 200 to the AC units.

Figure 3:
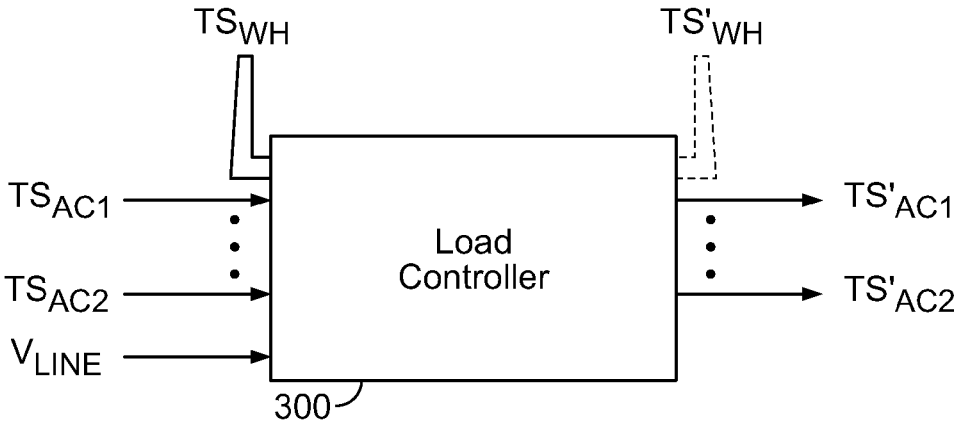
FIG. 3 is a functional block diagram of another specific load controller.

Referring to FIG. 3, a functional block diagram is shown of another specific load controller 300. In addition to the thermostat control signals $TS_{AC1}$ and $TS_{AC2}$ of FIG. 2, the load controller receives a further thermostat control signal $TS_{WH}$ for a water heater. In response to the thermostat control signals $TS_{AC1}$, $TS_{AC2}$, and $TS_{WH}$, the load controller produces corresponding output control signals $TS'_{AC1}$, $TS'_{AC2}$ and $TS'_{WH}$, respectively, for controlling an on/off state of a first AC unit, a second AC unit, and a water heater. In the example of FIG. 3, the thermostat control signal $TS_{WH}$ and the output control signal $TS'_{WH}$ are received and sent wirelessly.

Figure 4:
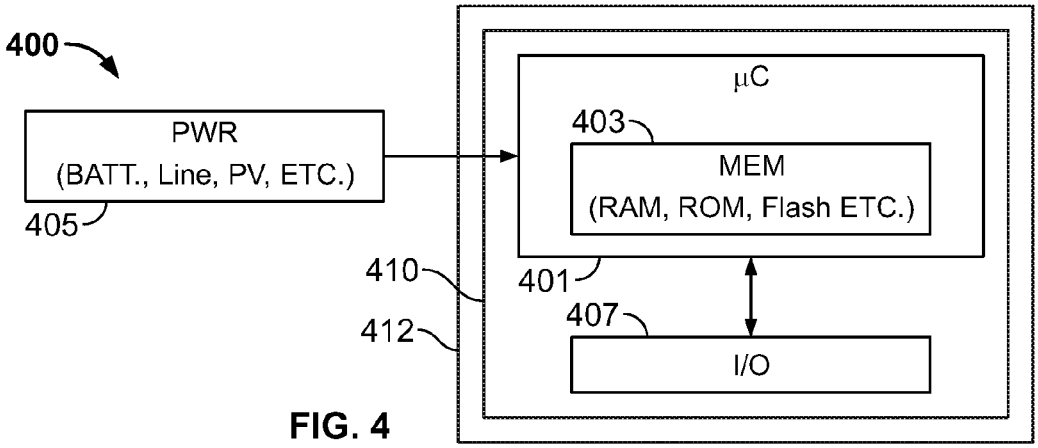
FIG. 4 is a functional block diagram of an embodiment of load controller circuitry.

Referring to FIG. 4, a functional block diagram is shown of an embodiment of load controller circuitry 400 that may be used in the load controllers of FIGS. 1-3. Logic circuitry such as a microcontroller 401 is provided with one or more memory devices 403 (e.g., RAM, ROM, Flash, etc.). The logic circuitry 401 is powered by a power supply 405 that may be line-powered, powered by battery, powered by photovoltaics, etc. An input/output (I/O) module or unit 407 is coupled to the logic circuitry 401. The I/O module 407 receives thermostat control signals and outputs output control signals described in connection with FIGS. 1-3, and can also provide for user I/O such as input buttons or keypad, indicators, display, etc. The microcontroller 401 and the I/O unit 407 are provided on an electronic circuit board 410, which is housed within an enclosure 412. Any of the load controllers described herein can be configured like the microcontroller 401.

The microcontroller 401 has a time clock function to monitor and compare the ON demand of thermostat circuits, via the thermostat control signals, such as $TS_{AC1}$, $TS_{AC2}$, $TS_{WH}$. In general, the microcontroller 401 monitors the time that each thermostat is in the ON position (calling for heating or cooling). The microcontroller 401 compares the demand time of each thermostat (labeled T-Stat in Table 1 below) and selects a run sequence for each unit that minimizes run overlap (in other words, minimizes the time that multiple loads are operating simultaneously to meet a cooling or heating demand). By "operating" or "running" or "ON," it is meant that the AC unit or water heater is consuming power to cool or heat air or water. In an embodiment, the microcontroller 401 holds units in the OFF position and permits them to run at specified intervals to minimize the run overlap between units. By "OFF," the load in question may still be consuming a small amount of power, but it is not operating to provide a cooling or heating function. For example, in the case of an AC unit, "OFF" means the electric motor that drives the compressor is not rotating. The microcontroller 401 monitors the incoming power voltage via a conventional voltage sensing circuit (not shown) that senses the voltage at the $V_{LINE}$ input and executes an algorithm to determine a dropout, blackout or brownout condition (e.g., as a specified percentage drop in line voltage or a drop below a threshold that persists optionally for a predetermined period of time). The following Table 1 presents several exemplary scenarios for the case of two thermostat circuits, in which numbers represent minutes of run time per hour:

TABLE 1

| Demand, T-Stat 1 | Demand, T-Stat 2 | Run Overlap | % Overlap Reduction |
|---|---|---|---|
| 20 | 20 | −20 | 100 |
| 20 | 30 | −10 | 100 |
| 30 | 30 | 0 | 100 |
| 30 | 40 | 10 | 67 |
| 40 | 40 | 20 | 50 |
| 45 | 45 | 30 | 33 |
| 50 | 50 | 40 | 20 |
| 55 | 55 | 50 | 9 |
| 60 | 60 | 60 | 0 |

When both AC units are running continuously, the microcontroller 401 can force a five minute per hour shutdown of each AC unit, resulting in 10 minutes out of each hour that only one AC unit is running, resulting in a 17% reduction in overlap. This OFF time may be programmable by the customer or by a technician or may be remotely programmed as described below. In the case of AC units, statistics show that rarely will both units be running at maximum overlap.

The microcontroller 401 can use a random number generator for randomly delaying the startup time of a load after a power outage or deactivation of an AC unit to minimize power surge loads on the electrical grid. The microcontroller 401 can be programmed with a bypass mode that is activated when an AC or water heater unit is being serviced or needs to run continuously. Preferably, the microcontroller 401 is programmed to revert from the bypass mode back to a normal mode after some elapse of time (e.g., eight hours) to prevent the unit from being accidentally left in the bypass mode indefinitely.

The load controller 400 can communicate not only with the AC units and/or other related units but also with a module on an electric water heater using wired, wireless, power-line carrier (PLC) or other communications techniques. There is no requirement that the water heater thermostat setting be reported. The load controller 400 can control the water heater to run only during "gaps" in the operation of other electrical loads such that all the loads are not running at the same time. Two examples of such operation are illustrated in FIG. 5.

Figure 5:
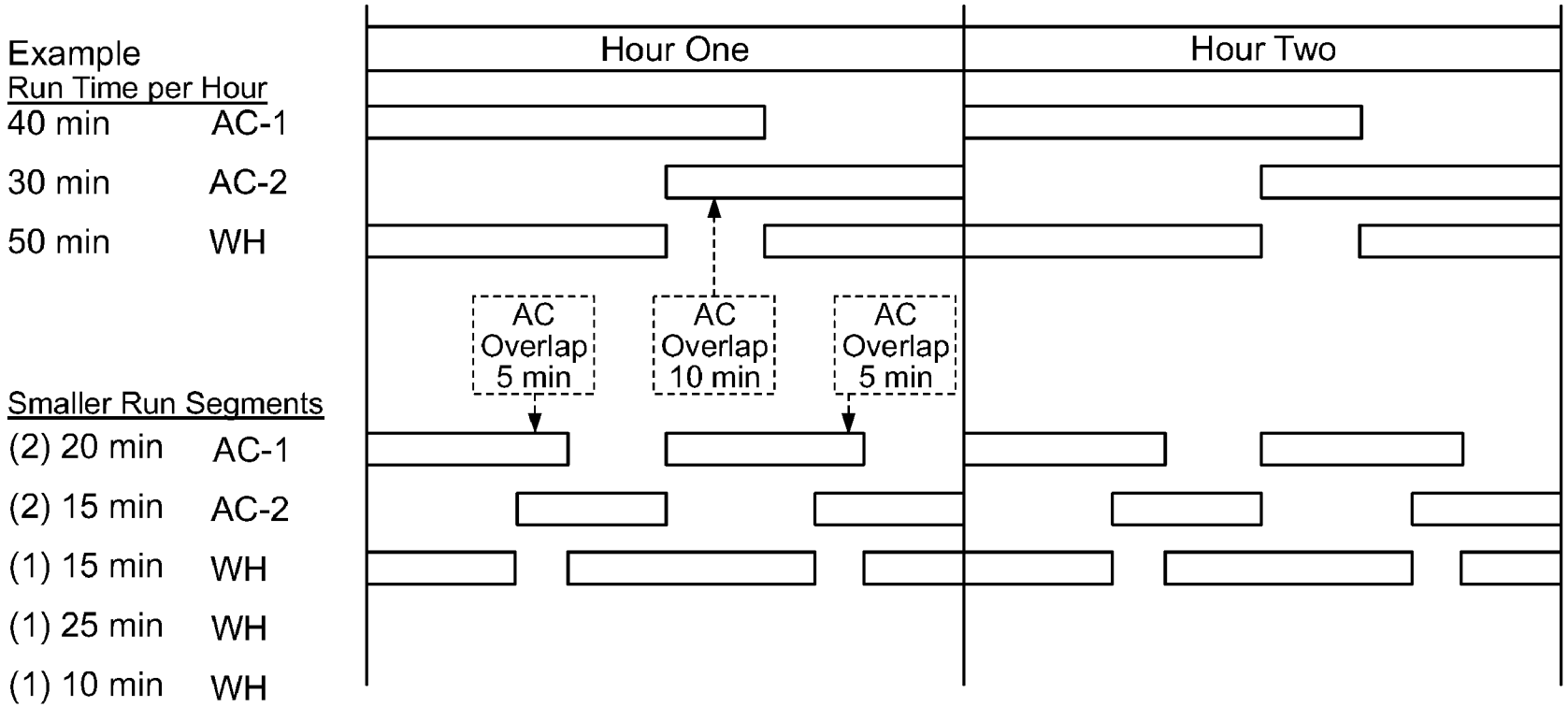
FIG. 5 is a functional block diagram illustrating operation of the load controller of FIG. 3.

As seen in the upper portion of FIG. 5, for example, a first AC unit AC-1 has a run time of 40 min/hour and a second AC unit AC-2 has a run time of 30 min/hour, resulting in an overlap between the first AC unit AC-1 and the second AC unit AC-2 of 10 min/hour during which both AC units AC-1 and AC-2 are operating to perform a cooling function. A water heater unit WH is turned OFF for 10 minutes during the overlapping operation of the first AC unit AC-1 and the second AC unit AC-2, and therefore has a run time of 50 min/hour. In this example, at any given time, no more than two out of the three loads are operating simultaneously.

In the lower portion of FIG. 5, run segments for a two-hour period controlled by a load spreading algorithm having smaller run segments is shown. The overlap time is reduced to 5 min at a time (10 min/hour total) by alternating the two AC units on and off as shown. The first AC unit AC-1 has a maximum run time of only 20 min/hour, and the second AC unit AC-2 has a maximum run time of 15 min/hour. First, the AC-1 unit is permitted to run for 20 minutes. 15 minutes later, the AC-2 unit is permitted to run for 15 minutes, resulting in a 5 minute time overlap when both AC-1 and AC-2 units are operating. The AC-2 unit is turned OFF for 15 minutes, and simultaneously the AC-1 unit is permitted to turn back ON and run for another 20 minutes. 15 minutes after the AC-2 unit is turned OFF, it is permitted to turn back on and run for another 15 minutes, resulting in a 5 minute overlap during the second half hour period, for a total of two 5-minute intervals in the hour when both AC-1 and AC-2 units are operating. The water heater unit WH has three variable run segments during the hour: 15 minutes, followed by a 5 minute OFF period, 25 minutes followed by a 5 minute OFF period, and 10 minutes, respectively, with two 5 minute intervals when the WH must remain OFF. In accordance with this load spreading algorithm, during any given hour, no more than two out of three loads are operating, and there are two 15-minute overlap intervals, two 10-minute overlap intervals, and two 5-minute overlap intervals.

The customer can assign via the user I/O a run priority to each electrical load. In the case of a water heater, a downstairs AC unit, and an upstairs AC unit, for example, the load spreading algorithm executed by the microcontroller 401 can be configured so that the water heater has a higher priority than the upstairs AC unit, thereby ensuring that hot water is always available. An option can also be provided to allow the load spreading algorithm to be configured so that the water heater is OFF during the day for energy savings and to allow maximum available power for the operation of AC units.

Figure 6:
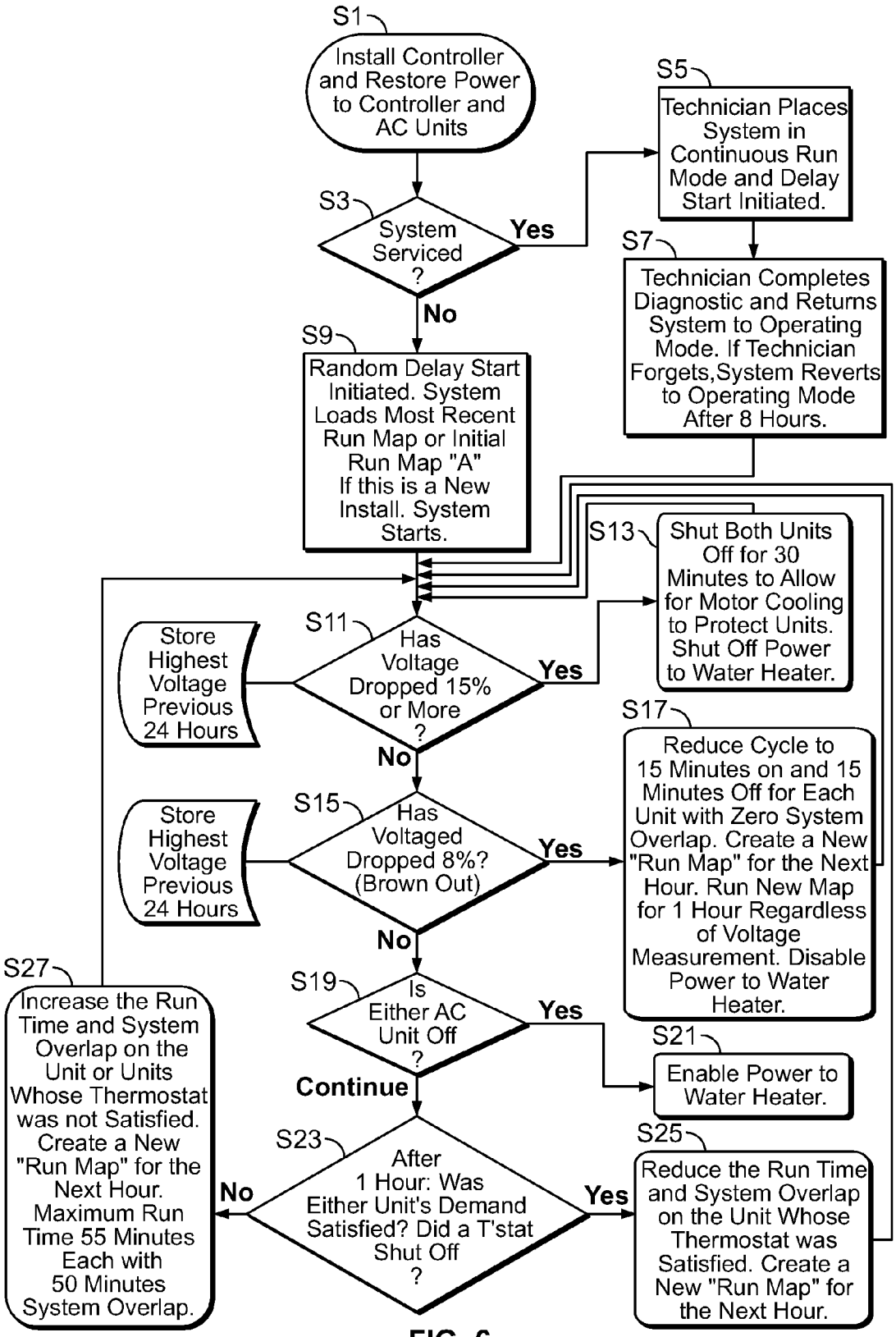
FIG. 6 is a flowchart illustrating operation of a load controller like that of FIG. 3.

FIG. 6 is a flowchart of an exemplary operation of any load controller disclosed herein. In the following example, the electrical loads are assumed to be AC units and a water heater unit. The automated aspects of this flowchart represent a load spreading algorithm 600 that is executed by any of the load controllers described herein for controlling any of the loads described herein. The algorithm 600 can be placed in a number of modes, including: a service mode, an operating mode, a continuous run mode, a bypass mode, and a normal (non-bypass) mode.

In block S1, the controller is installed between the thermostats and the AC units and the water heater unit, and power is restored to the controller and the AC units. In block S3, the controller determines whether a service mode has been selected by a technician. If so, in block S5, the algorithm 600 enters continuous run mode and initiates a delayed start subroutine, described below. In block S7, the technician completes diagnostics on the AC units, and the algorithm 600 returns to an operating mode. If the technician forgets to return the algorithm 600 to the operating mode, the algorithm 600 reverts to the operating mode after eight hours, for example.

At block S3, if the service mode has not been selected, operation proceeds to block S9 in which the algorithm 600 initiates a random delay start subroutine. The algorithm 600 loads the most recent Run Map, which determines the "run cycle," or ON and OFF durations for each load per unit time (e.g., one-half hour or one hour), or an Initial Run Map in the case of a new installation. The algorithm 600 starts controlling the operation of the loads according to the selected Run Map. The algorithm 600 can generate random delay start times for the loads using a random number generator, for example. In an embodiment, the Initial Run Map calls for 25 minutes ON and 5 minutes OFF for each AC unit (40 minutes of overlap for the first hour). During operation, the algorithm 600 monitors the line voltage, and the algorithm 600 stores the highest voltage during the previous 24 hours. The algorithm 600 also determines whether a condition of reduced power availability exists via circuitry in any of the load controllers disclosed herein. In block S11, the algorithm 600 determines whether the line voltage has dropped 15% or more. If so, in block S13, the algorithm 600 shuts off both AC units for 30 minutes to allow for motor cooling to protect the units. The algorithm 600 also shuts off power to the water heater. Operations returns to block S11. If at block S11 the voltage has not dropped 15% or more, at block S15, the algorithm 600 determines whether the line voltage has dropped 8% or more, corresponding to a brownout condition. If so, in block S17 the algorithm 600 modifies the Run Map to reduce the cycle to 15 minutes ON and 15 minutes OFF for each AC unit with zero overlap. The algorithm 600 follows the new Run Map for the next hour regardless of voltage measurement and disables power to the water heater.

If the line voltage checks at blocks S11 and S15 prove satisfactory, then at block S19, the algorithm 600 determines whether either AC unit is OFF. If so, the algorithm 600 causes power to be turned on to the water heater (S21). If not, operation continues to block S23. In block S23, after the current Run Map has run for one hour, the algorithm 600 determines for which AC units demand was satisfied (as indicated by its thermostat shutting off) and for which AC units demand was not satisfied. For AC units whose demand was satisfied, the algorithm 600 reduces the run time and operational overlap, and the algorithm 600 creates a new Run Map for the next hour (block S25). For AC units whose demand was not satisfied, the algorithm 600 increases the run time and operational overlap, and creates a new Run Map for the next hour (block S27). The maximum allowed run time is 55 minutes for each unit with 50 minutes system overlap.

When the AC units are running, the refrigerant pressure inside the compressor is at a high level. If the AC unit is stopped and immediately restarted, the electric motor driving the compressor may not be able to start against the high pressure. Given a few minutes, the pressures inside the refrigerant system equalize. Then the motor has no trouble starting against a much lower pressure. Accordingly, an OFF cycle is not allowed to be shorter than five minutes to allow for pressure equalization inside the compressor of an AC unit. That is, the load spreading algorithm 600 delays reactivating an air conditioning unit following a deactivation thereof to allow pressure in the compressor of the deactivated air conditioning unit to equalize before being reactivated. Whenever power goes off and is restored, the algorithm 600 restarts as in the case of an initial installation.

When the AC units are on a long run sequence, for example 40 minutes or longer, the controller may break up the long run into smaller segments so that AC units do not experience a long OFF time, causing room temperature to fluctuate too much. An example of this is illustrated in FIG. 5. Instead of operating the AC1, AC2 and WH (water heater) units with run cycles of 40, 30 and 50 minutes, respectively, with an overlap of 10 minutes for AC1 and AC2, as shown in the upper portion of FIG. 5, they are operated with cycles of 20, 15 and 25 minutes, respectively, with an overlap of 5 minutes. The AC2 unit then, instead of being OFF 30 minutes at a time, is OFF only 15 minutes at a time.

The foregoing load spreading algorithm 600 prevents both air conditioning units from operating simultaneously for a period of time to reduce electrical demand on a utility grid to which the air conditioning units are connected. The algorithm 600 permits both air conditioning units to operate simultaneously for a period of time when it determines that a cooling demand cannot be satisfied operating only one of the air conditioning units. The algorithm 600 can cause power to be cycled to each of the air conditioning units until a criterion is satisfied, e.g., a change in power availability, a change in cooling demand, etc.

In the case of a system including a water heater, connection to the water heater relay can be wired, wireless, power-line carrier, etc. There is no requirement that the water heater thermostat setting be reported.

The algorithm 600 minimizes the time that peak kilowatts are consumed by the electrical loads. Customers where peak surcharges apply may therefore benefit. Utilities benefit because the units are allowed to run a maximum of 55 minutes out of each hour, reducing the demand on the electrical grid by at least 8%. Utilities further benefit in that peak demand is reduced significantly by allowing only a subset (e.g., two of three) of heavy electrical loads to operate at the same time.

Figure 7:
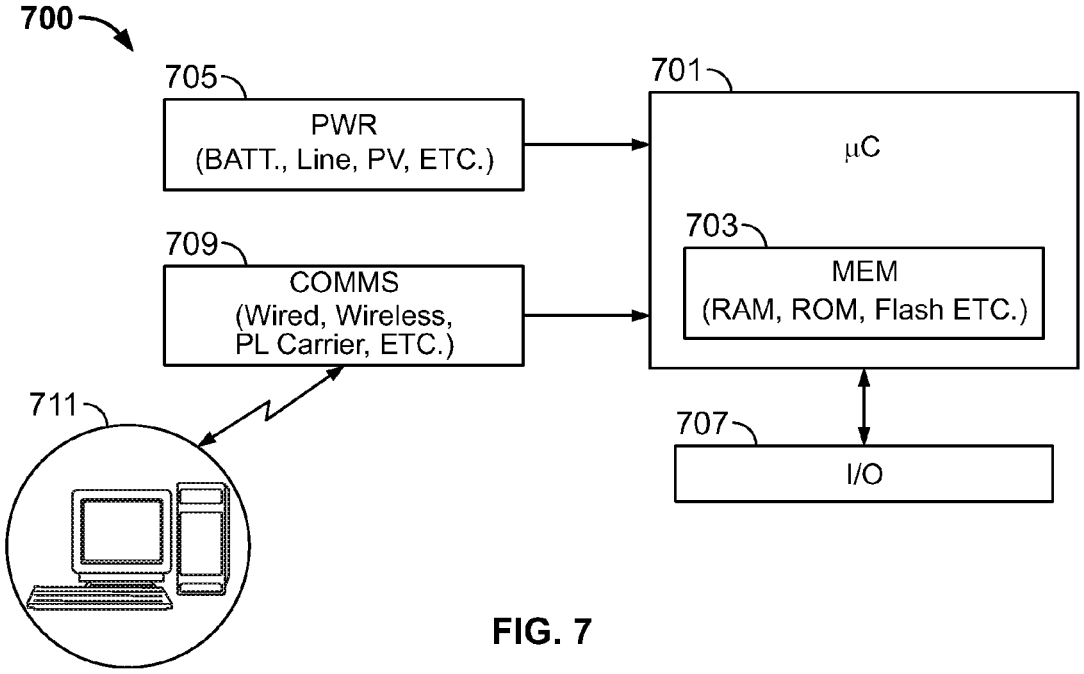
FIG. 7 is a functional block diagram of another embodiment of load controller circuitry.

Referring to FIG. 7, a block diagram is shown of another embodiment of load controller circuitry 700. As compared to the load controller circuitry 400 of FIG. 4, the load controller circuitry 700 of FIG. 7 is provided in addition with a communications module 709 that includes wireless communications circuitry and provides communication capabilities that may include wired communications, wireless communications, power-line carrier communications, etc. In an embodiment, the communications module 709 is configured for WiFi communications or Internet Protocol (IP) communications. The wireless communications circuitry can be accessible by a utility provider, which supplies energy to a utility grid to which the loads are connected.

Using WiFi, IP, or other wireless communication protocols, the load controller 700 can be connected to electrical loads (such as a water heater provided with similar wireless capabilities). Furthermore, the load controller 700 can be connected to a computer 711 such as a home computer. The home computer 711 can in turn be connected through the Internet to an electricity provider such as the utility company. In some instances, the utility company can be allowed to communicate directly with the load controller 700 to turn off or curtail operation of selected electrical loads based on the condition of the supply grid. In some instances, in exchange for allowing this capability, the customer can receive a discount. Connectivity can be used to remotely program the load controller 700, including programming the line drop for determining a brownout condition, minimum "off" time per hour, load priorities, etc.

Using WiFi or other wireless communication capabilities, cooperative load spreading may be performed between different residences, owners, tenants, occupants, etc. Incentives for such cooperative load spreading can be offered in the form of discounts.

Figure 8:
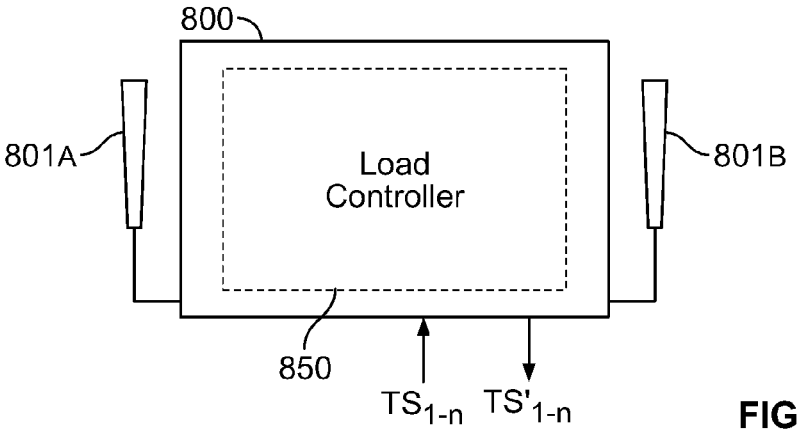
FIG. 8 is a functional block diagram illustrating a switch unit containing a load controller like that of FIG. 1.

FIG. 8 illustrates a functional block diagram of an electronic air conditioning control system in the form of a switch unit 800 that includes a load controller 850 like that of FIG. 1. The switch unit 800 can be, for example a dual AC disconnect switch assembly. Disconnect switches 901A and 901B allow respective AC units to be disconnected from power to allow servicing, for example. In an embodiment, a load controller 850 like that of FIG. 1 is provided in the form of an electronic circuit board adjacent a rear enclosure or housing of the switch unit 800. Because of the proximity of the switch unit 800 to the AC units, the thermostat signals for the AC units are readily accessible and can be connected by wire to the load controller 850. Likewise, modified thermostat signals output by the load controller 850 can be connected by wire to the AC units. Also, line voltage is readily accessible. A conventional voltage sensor like that described in connection with FIG. 1 can be provided on the electronic circuit board to monitor line voltage. The load controller can be programmed to cause the air conditioning units to be deactivated in response to a voltage sensing circuit (not shown) detecting a loss of voltage of at least a threshold amount. Of course, many other embodiments are contemplated, this particular embodiment being merely illustrative.

In another embodiment, the load controller is realized in the form of software running on a home computer. Connectivity between the computer and various electrical loads may achieved using WiFi or any of the techniques previously described or other techniques commonly known. Instead of monitoring line voltage, line voltage conditions may be communicated from the utility company, for example.

While particular aspects, embodiments, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An electronic control system for multiple air conditioning units, comprising:

an enclosure;

an electronic circuit board within the enclosure, the electronic circuit board having a first input terminal that receives a first thermostat control signal from a first thermostat intended to control a first air conditioning unit and a second input terminal that receives a second thermostat control signal from a second thermostat intended to control a second air conditioning unit, the electronic circuit board further including a first output terminal coupled to the first air conditioning unit and a second output terminal coupled to the second air conditioning unit; and a controller, on the electronic circuit board, programmed with instructions stored in a memory coupled to the controller, the instructions causing the controller to monitor the first and second input terminals to apply a load spreading algorithm that determines the timing and duration of the thermostat control signals passed to the output terminals for activating or deactivating the air conditioning units such that overlapping operation of the air conditioning units is reduced;

wherein the load spreading algorithm prevents both air conditioning units from operating simultaneously for a predetermined period of time to reduce electrical demand on a utility grid to which the air conditioning units are connected, or wherein the load spreading algorithm permits both air conditioning units to operate simultaneously for a predetermined period of time when the algorithm determines, based on the input terminals, that a cooling demand cannot be satisfied with one of the air conditioning units deactivated.

2. The system of claim 1, wherein the circuit board includes a voltage sensing circuit that monitors a line voltage of a power supply line that supplies power to the air conditioning units, the controller being programmed to cause the air conditioning units to be deactivated in response to the voltage sensing circuit detecting a loss of voltage of at least a threshold amount.

3. The system of claim 2, wherein the controller is further programmed to reactivate the air conditioning units at different times that are randomly determined according to a random number generator following deactivation of the air conditioning units in response to the loss of voltage.

4. The system of claim 1, wherein the load spreading algorithm causes power to be cycled to each of the air conditioning units until a criterion is satisfied.

5. The system of claim 1, wherein the load spreading algorithm delays reactivating one of the air conditioning units following a deactivation thereof to allow pressure in the deactivated air conditioning unit to equalize before being reactivated.

6. A load controller for controlling a plurality of heating or cooling electrical loads, comprising:

an input/output unit having a plurality of inputs for accepting thermostat control signals from a plurality of thermostats and further having a plurality of outputs for producing output control signals for activating or deactivating the plurality of electrical loads; and a logic circuit coupled to the input/output unit, the logic circuit having means for monitoring the thermostat control signals and for determining the timing and duration of the thermostat control signals passed to the outputs for activating or deactivating the heating or cooling loads such that overlapping operation of the plurality of electrical loads is reduced, wherein the electrical loads include at least two air conditioning units, wherein the logic circuitry is configured to:

set run cycles for each of the plurality of electrical loads for a period of time, produce output control signals based on the run cycles, and for each of the plurality of electrical loads, monitor during the period of time whether a thermostat control signal for a corresponding one of the electrical loads changes to an OFF state.

7. The apparatus of claim 6, comprising:

a sensor for sensing a condition of reduced power availability, wherein the means for determining the timing and duration of the thermostat control signals passed to the outputs reduces or discontinues operation of one or more of the electrical loads in response to the sensing the condition of reduced power availability.

8. The apparatus of claim 6, further comprising wireless communications circuitry coupled to the logic circuitry, wherein the electrical loads includes a water heater that communicates wirelessly with the wireless communications circuitry.

9. The apparatus of claim 8, wherein the wireless communications circuitry is configured for Internet Protocol communications.

10. The apparatus of claim 9, wherein the wireless communications circuitry is accessible by a utility provider.

11. The apparatus of claim 6, wherein the logic circuitry is configured to, after the period of time has expired, set run cycles for the plurality of plurality loads for a succeeding period of time based on the thermostat control signals.

12. The apparatus of claim 11, wherein the logic circuitry is configured to set run cycles by increasing the run cycle of the one electrical load when the thermostat control signal for that electrical load did not change to an OFF state during the period of time.

13. The apparatus of claim 11, wherein the logic circuitry is configured to set run cycles by decreasing the run cycle of the one electrical load when the thermostat control signal for that load did change to an OFF state during the period of time.

14. The apparatus of claim 6, wherein the electrical loads include a first air conditioning unit and a second air conditioning unit.

15. The apparatus of claim 6, wherein the electrical loads include a first air conditioning unit, a second air conditioning unit, and a water heater unit.

16. The apparatus of claim 15, wherein the logic circuitry produces the output control signal for the water heater unit such that the water heater unit is turned ON responsive to the first air conditioning unit or the second air conditioning unit being turned OFF.

17. The apparatus of claim 6, wherein the electrical loads include an air conditioning unit and a water heater unit.

18. An electronic control system for multiple air conditioning units, comprising:

an enclosure;

an electronic circuit board within the enclosure, the electronic circuit board having a first input terminal that receives a first thermostat control signal from a first thermostat intended to control a first air conditioning unit and a second input terminal that receives a second thermostat control signal from a second thermostat intended to control a second air conditioning unit, the electronic circuit board further including a first output terminal coupled to the first air conditioning unit and a second output terminal coupled to the second air conditioning unit; and a controller, on the electronic circuit board, programmed with instructions stored in a memory coupled to the controller, the instructions causing the controller to monitor the first and second input terminals to apply a load spreading algorithm that determines the timing and duration of the thermostat control signals passed to the output terminals for activating or deactivating the air conditioning units such that overlapping operation of the air conditioning units is reduced, wherein the load spreading algorithm causes power to be cycled to each of the air conditioning units until a criterion is satisfied.

19. The system of claim 18, wherein the load spreading algorithm prevents both air conditioning units from operating simultaneously for a predetermined period of time to reduce electrical demand on a utility grid to which the air conditioning units are connected, or wherein the load spreading algorithm permits both air conditioning units to operate simultaneously for a predetermined period of time when the algorithm determines, based on the input terminals, that a cooling demand cannot be satisfied with one of the air conditioning units deactivated, or wherein the load spreading algorithm delays reactivating one of the air conditioning units following a deactivation thereof to allow pressure in the deactivated air conditioning unit to equalize before being reactivated.

20. A load controller for controlling a plurality of heating or cooling electrical loads, comprising:

an input/output unit having a plurality of inputs for accepting thermostat control signals from a plurality of thermostats and further having a plurality of outputs for producing output control signals for activating or deactivating the plurality of electrical loads; and a logic circuit coupled to the input/output unit, the logic circuit having means for monitoring the thermostat control signals and for determining the timing and duration of the thermostat control signals passed to the outputs for activating or deactivating the heating or cooling loads such that overlapping operation of the plurality of electrical loads is reduced, wherein the electrical loads include a first air conditioning unit, a second air conditioning unit, and a water heater unit, and wherein the logic circuitry produces the output control signal for the water heater unit such that the water heater unit is turned ON responsive to the first air conditioning unit or the second air conditioning unit being turned OFF.

* * * * *